US007479016B2

(12) United States Patent
Takahashi et al.

(10) Patent No.: US 7,479,016 B2
(45) Date of Patent: Jan. 20, 2009

(54) SEMICONDUCTOR DEVICE SOCKET

(75) Inventors: Katunori Takahashi, Higashimurayama (JP); Fumiaki Otsuji, Kawasaki (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 11/492,096

(22) Filed: Jul. 25, 2006

(65) Prior Publication Data

US 2007/0026699 A1 Feb. 1, 2007

(30) Foreign Application Priority Data

Jul. 26, 2005 (JP) ..... 2005-215723

(51) Int. Cl.
*H01R 12/00* (2006.01)

(52) U.S. Cl. ..... 439/66; 439/876

(58) Field of Classification Search ..... 439/66, 439/876, 83, 91

See application file for complete search history.

(56) References Cited

U.S. PATENT DOCUMENTS

| | | | | |
|---|---|---|---|---|
| 4,029,375 | A * | 6/1977 | Gabrielian | 439/66 |
| 4,961,709 | A * | 10/1990 | Noschese | 439/66 |
| 5,718,040 | A * | 2/1998 | Faure et al. | 29/846 |
| 6,095,823 | A * | 8/2000 | Banks | 439/66 |
| 6,190,181 | B1 | 2/2001 | Affolter et al. | |
| 6,390,826 | B1 | 5/2002 | Affolter et al. | |
| 2002/0048973 | A1 * | 4/2002 | Zhou et al. | 439/66 |
| 2004/0147140 | A1 * | 7/2004 | Fan et al. | 439/66 |
| 2004/0166702 | A1 * | 8/2004 | Higashi | 439/66 |

FOREIGN PATENT DOCUMENTS

| | | |
|---|---|---|
| CN | 1225230 A | 8/1999 |
| JP | 3008887 | 1/1995 |
| JP | 9-121007 | 5/1997 |
| JP | 10-112367 | 4/1998 |
| JP | 11-67396 | 3/1999 |
| JP | 2001-52824 | 2/2001 |
| JP | 2002-14113 | 1/2002 |
| JP | 2002-170617 | 6/2002 |
| JP | 2002-324603 | 11/2002 |
| JP | 2003-100375 | 4/2003 |

OTHER PUBLICATIONS

Official Notice of Rejection dated Nov. 9, 2007 in Chinese Patent Application No. 200610107451.0.

* cited by examiner

*Primary Examiner*—James Harvey
(74) *Attorney, Agent, or Firm*—Finnegan, Henderson, Farabow, Garrett & Dunner, LLP

(57) ABSTRACT

A semiconductor device socket is for electrically connecting between a semiconductor device and a printed-wiring board. The semiconductor device socket includes a socket body having contacts to be electrically contacted with the semiconductor device, and a connection mechanism provided between the socket body and the printed-wiring board, and having connection members for electrically connecting between the contacts and the printed-wiring board and an alignment plate having through-holes in which the connection members are provided, wherein the connection member of the connection mechanism has a first spring portion having a first free end, a support portion having an outer diameter greater than an inner diameter of the through-hole, and a second spring portion having a second free end.

26 Claims, 6 Drawing Sheets

SEMICONDUCTOR DEVICE SOCKET

This application claims priority from Japanese Patent Application No. 2005-215723 filed Jul. 26, 2005, which is hereby incorporated by reference herein.

BACKGROUND OF THE INVENTION

1. Field of the Invention

This invention relates to a semiconductor device socket and more particularly to a semiconductor device socket on which a semiconductor device is mounted and which can be attached to a printed-wiring board, such as a test board or a burn-in board, without the application of solder.

2. Description of the Related Art

Where performing a screening of semiconductor devices, such as IC packages, bare chips or KGDs (known good dies) according to a conducted electric or burn-in test, it is a conventional practice to electrically connect between the semiconductor device and the printed-wiring board using a semiconductor device socket arranged on the printed-wiring board, such as a test board or a burn-in board.

For example, there is known a semiconductor device socket arranged on a printed-wiring board wherein the semiconductor device socket has a pitch of contacts different from the pitch of pads on the printed-wiring board, as shown in FIG. 6.

FIG. 6 shows the existing semiconductor device socket.

In FIG. 6, reference numeral 101 designates a semiconductor device socket on which a semiconductor device is mounted. The semiconductor device socket 101 is basically constructed with a socket body 104 having a receptacle to receive therein a semiconductor device, contacts 105 provided in plurality in the socket body 104 and to be electrically contacted with a semiconductor device received, a pitch-changing board 102 referred to later, a spacer 115 arranged underneath the pitch-changing board 102, and a connection pins 103 provided on the pitch-changing board 102.

The semiconductor device socket 101 is arranged with a plurality of contacts corresponding to the terminals of a semiconductor device.

The contacts 105 protrude from the bottom of the socket body 104 toward the pitch-changing board 102. Those are connected to the pitch-changing board 102 by soldering.

In a central region of the pitch-changing board 102, a plurality of contact holes (not shown) are formed to be matched for the contacts 105 to be inserted.

In the periphery of the central region in which the contact holes are formed, connection-pin holes (not shown), to which conductive pattern is wired from the contact holes and in which the connection pins 103 can be inserted to connect between the pitch-changing board 102 and the printed-wiring board 110, are provided at a pitch greater than the pitch of the contacts 105.

By soldering the connection pins 103 to the printed-wiring board 110, the pitch-changing board 102 can be connected to the printed-wiring board 110. Namely, the semiconductor device socket 101 connected to the pitch-changing board 102 can be electrically connected to the printed-wiring board 110.

Reference numeral 115 designates a spacer interposed between the pitch-changing board 102 and the printed-wiring board 110. The spacer 115 is used to release the cleaning solution during a cleaning performed after soldering the connection pins 103 and the printed-wiring board 110 together.

For such a connection mechanism for electrically connecting between a semiconductor device and a printed-wiring board or a connection mechanism between wiring boards, there are proposed the connection mechanisms as disclosed in Japanese patent Application Laid-open Nos. 2001-52824, 2002-14113 and 2002-324603.

However, in the proposed connection mechanism for electrically connecting between a semiconductor device and a printed-wiring board or the connection mechanism between wiring boards, the contacts constituting the connection mechanism still require being soldered at one ends thereof. Thus, there are included those in which the contacts themselves could not be changed.

Conventional contact support mechanisms, on the board supporting the contacts forming a connection mechanism, can be complicated and difficult to manufacture. Furthermore, when changing the semiconductor device socket attached on a printed-wiring board, such as a test board or a burn-in board, the the components forming the connection mechanism including the contacts tend to separate apart. Thus, attaching the semiconductor device socket to the printed-wiring board or the like can be difficult.

It is an object of the present invention to provide a connection mechanism that, by simplifying the structure of the components forming a connection mechanism, mounting and dismounting of the semiconductor device socket is facilitated in the manufacture and exchange thereof wherein electric connection is positively obtained between the wiring boards and between the semiconductor device socket and the wiring board, and a semiconductor device socket using such a connection mechanism.

SUMMARY OF THE INVENTION

In accordance with the present invention, there is provided a semiconductor device socket for electrically connecting between a semiconductor device and a printed-wiring board. The semiconductor device socket comprises a socket body, and a connection mechanism. The socket body has contacts to be electrically contacted with the semiconductor device. The connecting mechanism is provided between the socket body and the printed-wiring board. The connecting mechanism includes connection members for electrically connecting the contacts to contact pads of the printed-wiring board, and an alignment plate having through-holes in which the connection members are provided. The connection member of the connection mechanism has a first spring portion having a first free end, a support portion having an outer diameter greater than an inner diameter of the through-hole, and a second spring portion having a second free end.

It is preferable that the connection member further has a positioning portion having an outer diameter smaller than the outer diameter of the support portion and the inner diameter of the through-hole.

It is preferable that the through-hole formed in the alignment plate has an inner surface on which metal plating is applied and the alignment plate is embedded with a copper foil wire.

Because soldering is not required, the semiconductor device socket in the invention can be easily attached to and detached from a printed-wiring board, such as a test board or a burn-in board.

Meanwhile, the connection mechanism is easy to manufacture because of no need of an especial fixing structure for components constituting a connection mechanism.

Furthermore, because two spring portions are provided for the spring member serving as a contact constituting the connection mechanism, electric connection is to be positively provided between the wiring boards and between the semiconductor device socket and the wiring board.

The above and other objects, effects, features and advantages of the present invention will become more apparent from the following description of embodiments thereof in conjunction with the accompanying drawings.

DETAILED DESCRIPTION OF THE PREFERRED EMBODIMENTS

With reference to FIGS. 1 to 5, embodiments of the present invention will now be described.

Figure 1B:
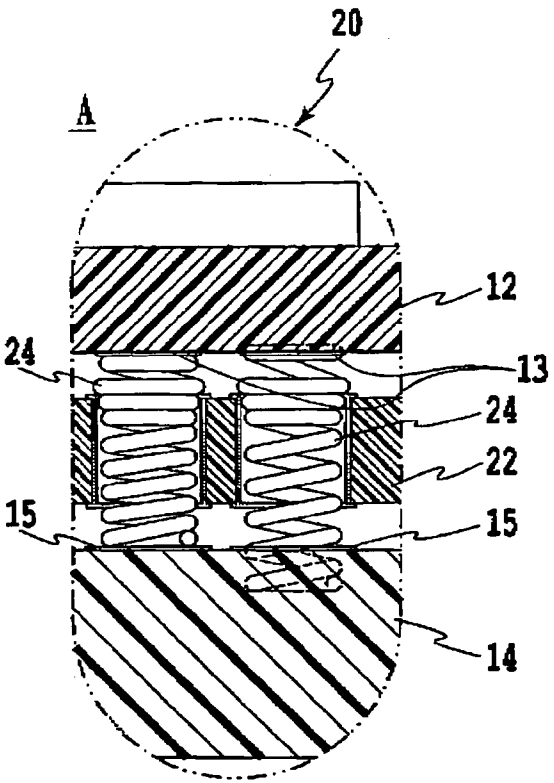
FIG. 1B is a sectional view of the connection mechanism in region A shown in FIG. 1A.
Figure 1A:
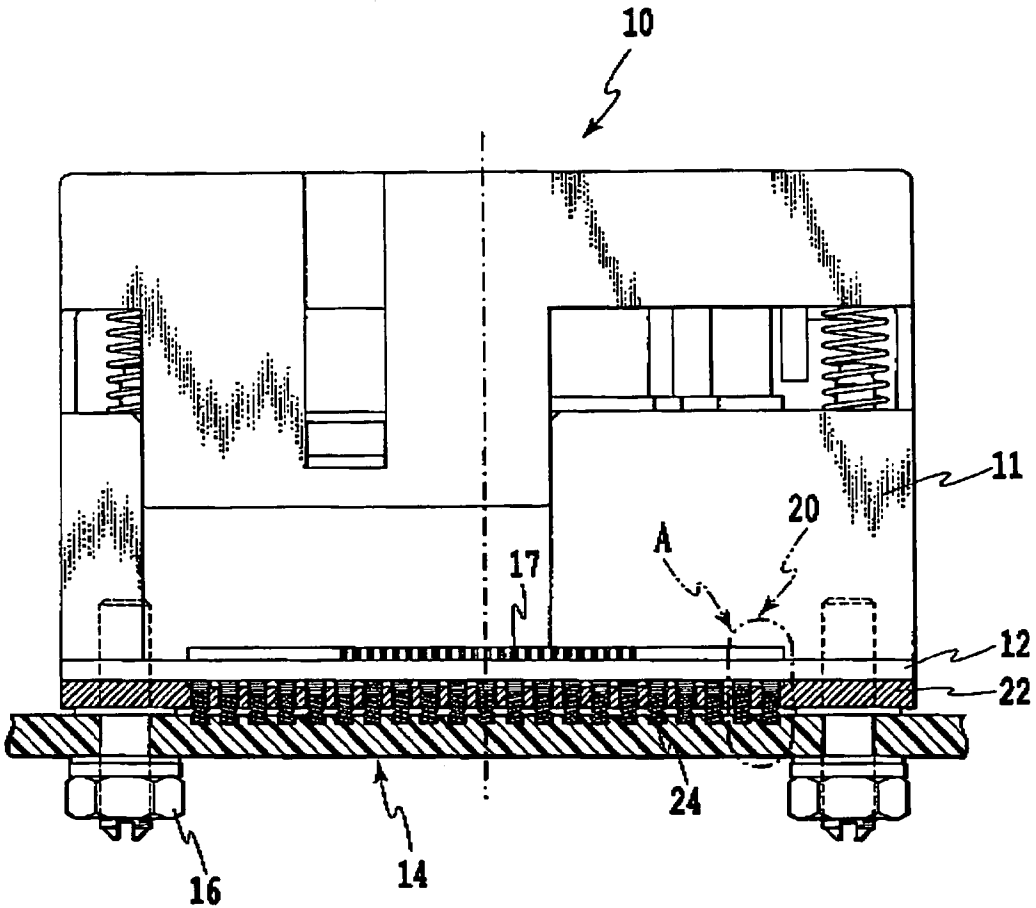
FIG. 1A is a schematic side view for explaining the outline of a connection mechanism wherein there is shown a connection mechanism for connecting a semiconductor device socket to a printed-wiring board through a pitch-changing board, according to a first embodiment of the invention.
Figure 2B:
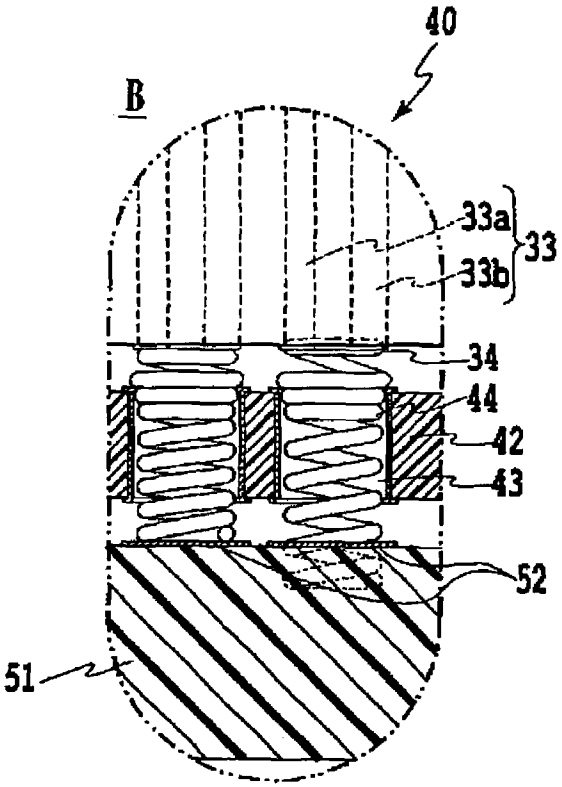
FIG. 2B is a sectional view of the connection mechanism in region B shown in FIG. 2A.
Figure 2A:
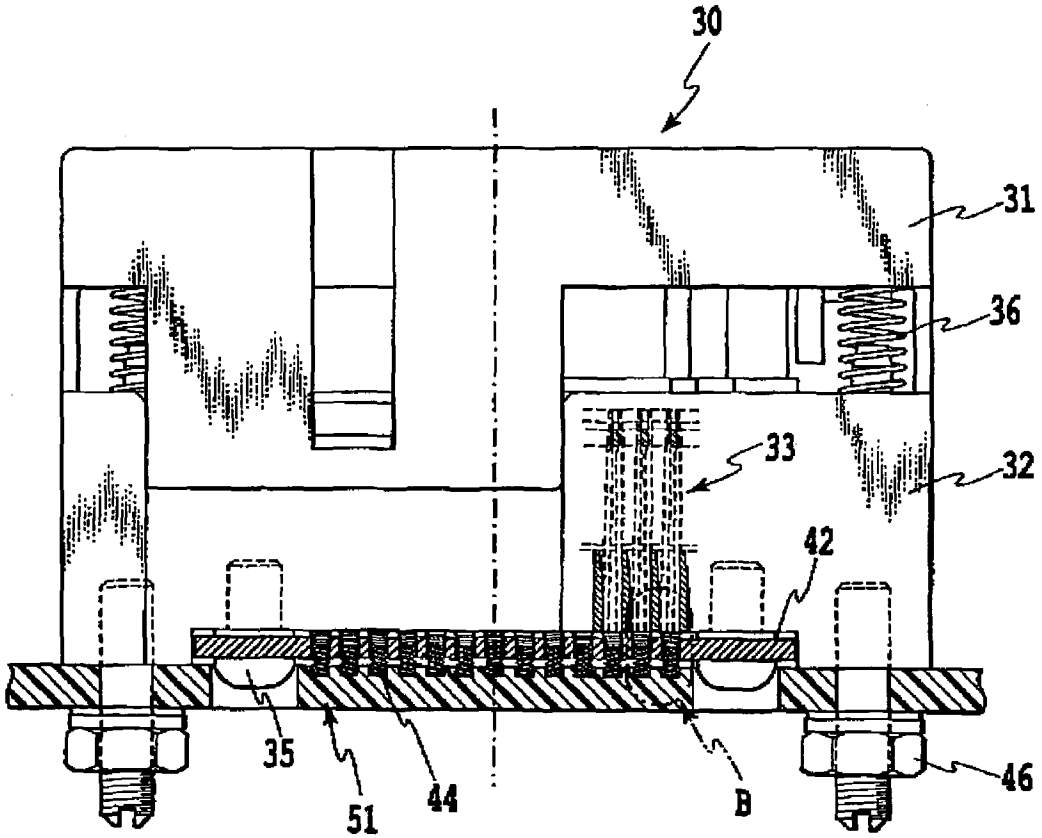
FIG. 2A is a schematic side view for explaining the outline of a connection mechanism wherein there is shown a connection mechanism for connecting a semiconductor device socket to a printed-wiring board, according to a second embodiment of the invention.

FIGS. 1A and 1B illustrates a connection mechanism of connecting a semiconductor device socket to a printed-wiring board through a pitch-changing board, according to a first embodiment of the invention. FIG. 1A is a schematic side view for explaining the outline of a semiconductor device socket while FIG. 1B is a sectional view of the connection mechanism at a region A in FIG. 1A. FIGS. 2A and 2B illustrates a connection mechanism of connecting a semiconductor device socket to a printed-wiring board, according to a second embodiment of the invention. FIG. 2A is a schematic side view for explaining the outline of the connection mechanism while FIG. 2B is a sectional view of the connection mechanism at a region B in FIG. 2A.

Figure 3:
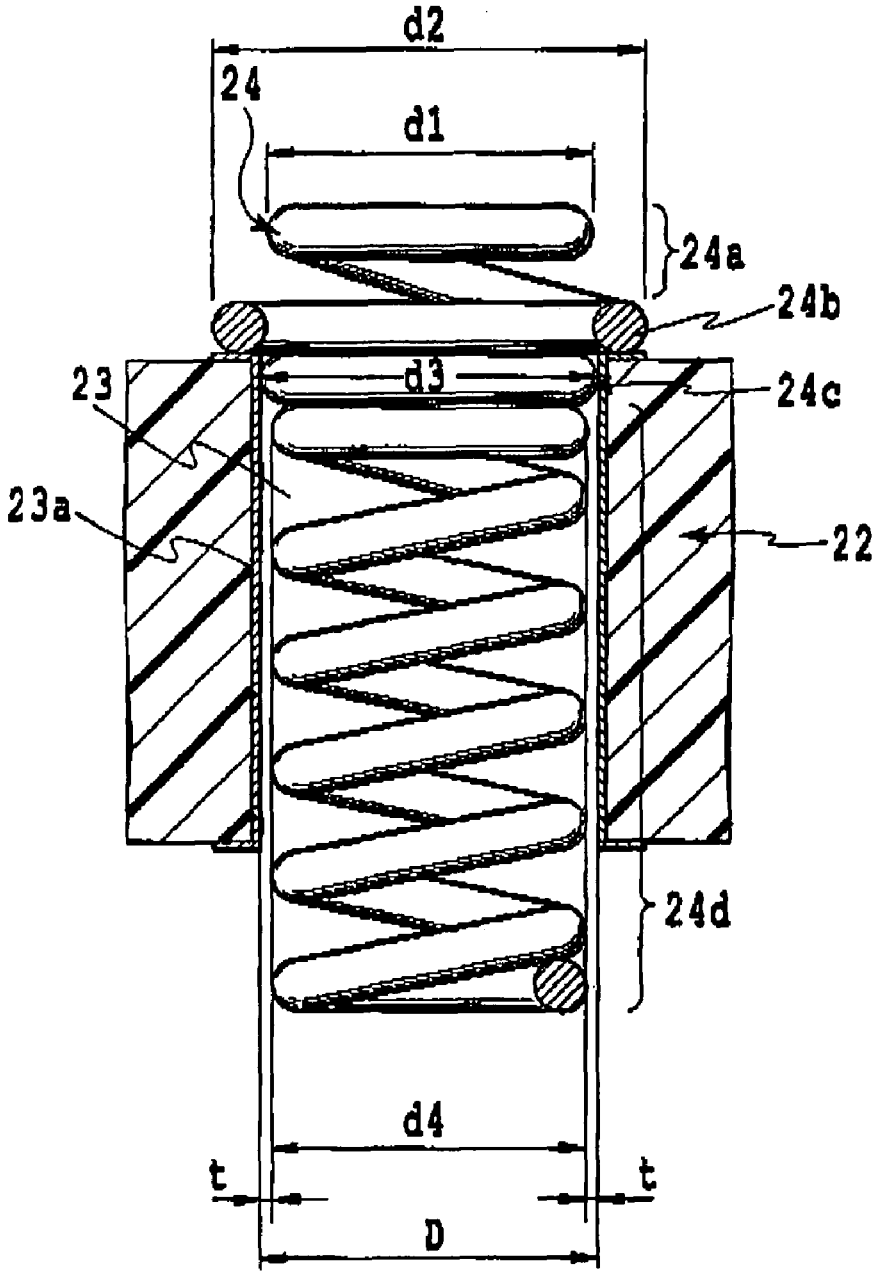
FIG. 3 is a sectional view showing the relationship between an alignment plate and a connection member that constitute a connection mechanism according to the invention.

FIG. 3 shows a sectional view illustrating the relationship between an alignment plate and a connection member, constituting a connection mechanism for a semiconductor device socket according to the invention.

Figure 4A:
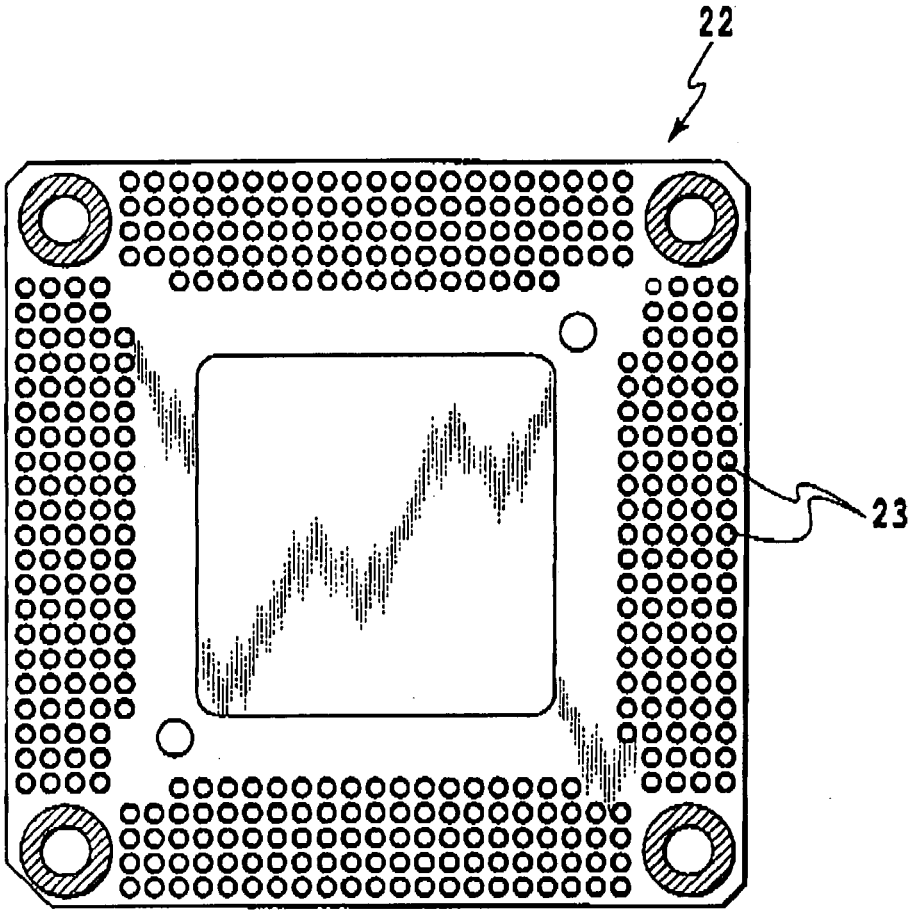
FIG. 4A is a plan view of an alignment plate in one embodiment.
Figure 4B:
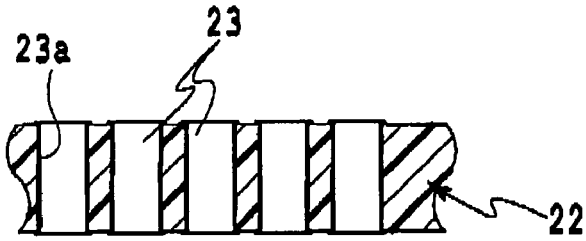
FIG. 4B is a sectional view of the alignment plate shown in FIG. 4A.
Figure 5A:
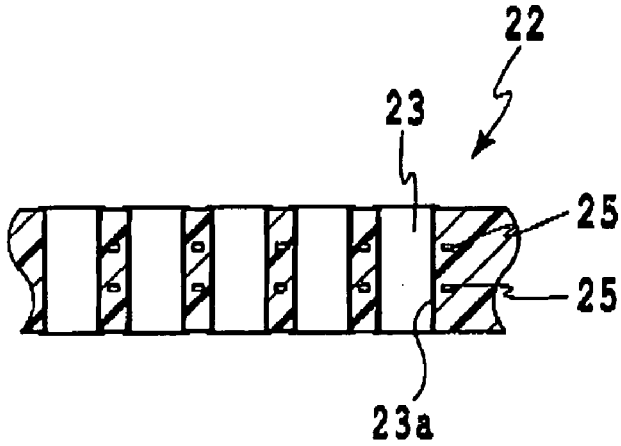
FIG. 5A is a plan view of an alignment plate in another embodiment.
Figure 5B:
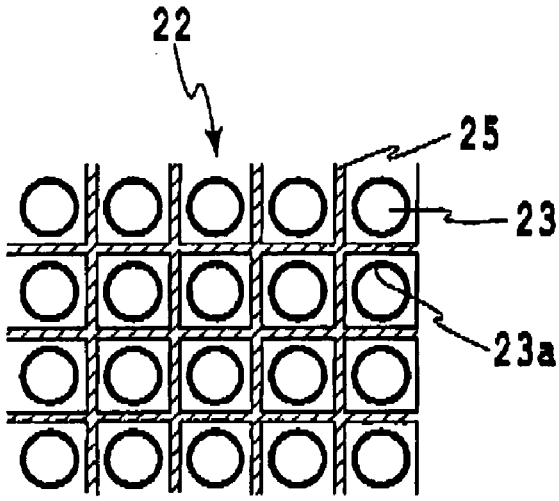
FIG. 5B is a sectional view of the alignment plate shown in FIG. 5A.
Figure 6:
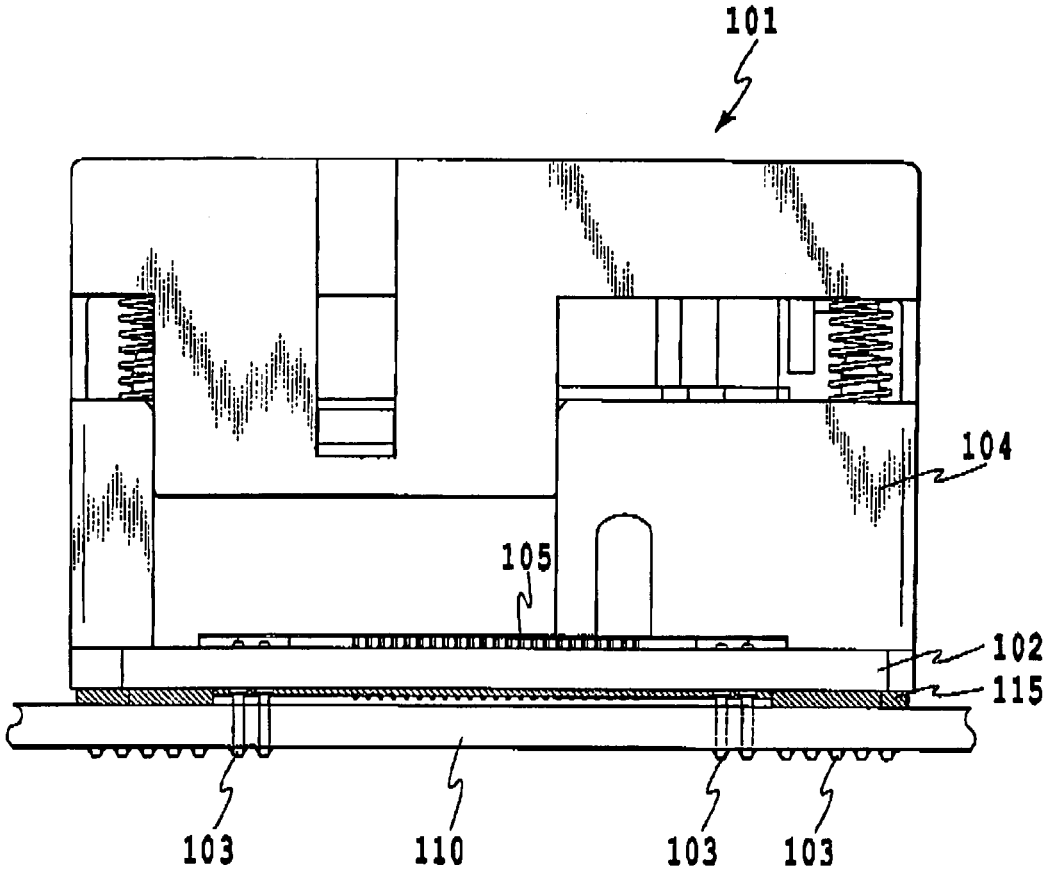
PRIOR ART FIG.6
FIG. 6 shows a connection mechanism in the existing semiconductor device socket.

FIG. 4A shows a plan view in one embodiment of the alignment plate while FIG. 4B is a sectional view of the FIG. 4A alignment plate. FIGS. 5A and 5B show another embodiment of an alignment plate. FIG. 5A is a plan view of the alignment plate while FIG. 5B is a sectional view of the FIG. 5A alignment plate.

FIRST EMBODIMENT

Referring to FIGS. 1A and 1B, reference numeral 10 designates a semiconductor device socket (hereinafter referred merely to as a "socket"). The socket 10, mounted on a printed-wiring board 14, is to removably receive therein a semiconductor device (not shown) such as an IC package, a bare chip or a KGD. The socket 10 is basically constructed with a socket body 11 having a receptacle (not shown) to receive therein a semiconductor device, a contact 17 provided in the socket body 11 and to be electrically contacted with a semiconductor device received, a pitch-changing board 12 electrically connecting between the socket and the printed-wiring board that are different in the pitch of terminals from each other, and a connection mechanism 20 for electrically connecting between the pitch-changing board 12 and the printed-wiring board 14.

The contact 17 may be in any form provided that it is suited for a semiconductor device received. For example, it may be in a type to provide an electric contact by clamping the exterior contacts of the semiconductor device or in a type to provide an electric contact by an abutment against the exterior contacts of the semiconductor device. In brief, satisfactorily applied is a contact member to be placed in electric contact with the semiconductor device received.

A pitch-changing board 12 is provided on the bottom of the socket 10, to electrically connect between the socket and the printed-wiring board that are different in the pitch of terminals from each other.

By using the pitch-changing board 12, the printed-wiring board 14 is decreased in the necessity to make its wiring pattern finer and increased in the freedom of wiring.

In a central region of the pitch-changing board 12, there are provided a plurality of contact holes (not shown) in which the contacts 17 of the socket 10 are to be inserted, correspondingly to the contacts 17.

In the periphery of the central region in which the contact holes are formed, there are provided pads (not shown) conductively wired from the contact holes at a pitch greater than the pitch of the contacts 17, in the upper surface of the pitch-changing board 12.

On the backside (or the lower surface) of the pitch-changing board 12, there are formed pads 13 respectively connected layer-to-layer with the pads formed on the upper surface, to electrically connect with connection members 24, referred to later. Although the pads are provided in this embodiment, those may be through-holes. In brief, it is satisfactory if connected between the upper and lower surfaces of the pitch-changing board.

A connection mechanism 20 is provided on the bottom of the pitch-changing board 12, to provide an electric connection between the pitch-changing board 12 and the printed-wiring board 14.

The connection mechanism 20 is structured with a plurality of connection members 24 electrically contacted with the pads or through-holes of the pitch-changing board 12 and with the pads or through-holes of the printed-wiring board 14, and an alignment plate 22 (also called a "locator") for holding the connection members 24 in position.

The alignment plate 22 is formed of an insulating resin, e.g. a glass epoxy resin. The alignment plate 22 is formed with a plurality of through-holes 23 in a matrix arrangement correspondingly to the plurality of pads 13 of the pitch-changing board 12, as shown in FIGS. 4A and 4B.

Gold plating is applied to the inner walls of the through-holes 23 to thereby form a gold-plating layer 23*a* in order to prevent the wear or roughening caused by expansion and contraction of the connection members 24 inserted.

The alignment plate 22 may be further embedded with a thin copper foil wire 25 between the through-holes 23, as shown in FIGS. 5A and 5B. The copper foil wire 25 is led to a through-hole (not shown) for grounding formed in the alignment plate 22. By doing so, such noise as crosstalk between the semiconductor device attached and the wiring board can be reduced when performing an electric test. Meanwhile, by embedding the copper foil wire 25 in a mesh form, the copper foil wire 25 can be laid in a manner surrounding the through-holes, thus obtaining further the noise-reduction effect.

Each of the connection members 24 is, for example, in a coil spring form, as shown in detail in FIG. 3. By such a coil spring form, the socket 10 can be decreased in its entire height. The connection member 24 serves as a member that electrically connects between the pitch-changing board 12 and the printed-wiring board 14, as mentioned before.

Accordingly, the connection member 24 is made up of a conductive material or insulating material applied thereon with a conductive plating. The connection members 24 are arranged respectively within the plurality of through-holes 23 formed in the alignment plate 22, as shown in FIGS. 1A, 1B and 3.

The connection member 24 includes a first spring portion 24*a*, a support portion 24*b*, a positioning portion 24*c*, and a second spring portion 24*d*, as shown in FIG. 3. An upper free end or first free end of the first spring portion 24*a* electrically contacts with the pad 13 of the pitch-changing board 12. The support portion 24*b* extends continuously from the first spring portion 24*a* and abuts on the alignment plate 22, thereby supporting the connection member 24. The positioning portion 24*c* extends continuously from the support portion 24*b* and is inserted in the through-hole 23 formed in the alignment plate 22. The second spring portion 24*d* extends continuously from the positioning portion 24*c* and has a lower free end, or second free end, electrically contacted with the pad 15 as an external contact of the wiring board 14.

The first spring portion 24*a* has an outer diameter $d_1$ set at a proper diameter correspondingly to the pad 13 of the pitch-changing board 12 in contact therewith. The support portion 24*b* has an outer diameter $d_2$ set sufficiently greater relative to an inner diameter D of the through-hole 23 of the alignment plate 22. Due to this, when the connection member 24 is inserted in the through-hole 23, the connection member 24 at its support portion 24*b* abuts against the surface of the alignment plate 22 thus being retained on the alignment plate 22. The positioning portion 24*c* has an outer diameter $d_3$ set slightly smaller than the inner diameter D of the through-hole 23. Due to this, even when the connection member 24 is inserted positionally deviated in the through-hole 23, the slight gap between the positioning portion 24*c* and the through-hole 23 allows for positional deviation, thus making it possible to position the connection member 24 in the through-hole 23. Meanwhile, owing to the positioning within the through-hole 23, the second spring portion 24*d* can be arranged centrally within the through-hole 23.

The second spring portion 24*d* has an outer diameter $d_4$ set somewhat smaller than the inner diameter D of the through-hole 23 so as to provide a clearance t for the through-hole 23 of the alignment plate 22. This allows the second spring portion 24*d* to vertically move within the through-hole 23, thus preventing the wear or roughening caused at the inside of the through-hole 23 due to expansion and contraction of the second spring portion 24*d*. Meanwhile, the lower free end of the second spring portion 24*d* is formed protruding out of the bottom of the alignment plate 22, as shown in the figure.

By virtue of providing the connection member 24 with the first and second spring portions 24*a*, 24*d* as described above, spring constant and length can be independently determined for the first and second spring portions 24*a*, 24*d* besides the settings of the respective diameters.

Namely, suitable contact pressure can be independently set as to the electric contacts between the upper free end (first free end) of the first spring portion 24*a* and the pad 13 of the pitch-changing board 12 and between the lower free end (second free end) of the second spring portion 24*d* and the pad 15 of the printed-wiring board 14. This accordingly allows for positive electric connections.

Meanwhile, the connection members 24 can be positively held in and easily removed out of the alignment plate 22 by providing those with the support and positioning portions 24*b*, 24*c*. Accordingly, the connection members 24 themselves can be easily changed. Furthermore, when the socket 10 is attached to and detached from the printed-wiring board 14, the connection members 24 and the alignment plate 22 can be easily handled as an integral member without separating from one another, and hence be easily changed.

Furthermore, the positioning portion 24*c* of the connection member 24 is preferably made one turn so as to reduce the arrangement height of the connection member 24 and provide a sufficient number of turns for the second spring portion 24*d*. By thus increasing the number of turns for the second spring portion 24*d*, it is possible to reduce the spring constant for the second spring portion 24*d* and to suppress the variation of spring force for the second spring portion 24*d*. Thus, those can be easily adjusted to the required contact pressure.

The socket 10, the pitch-changing board 12 and the connection mechanism 20 can be easily assembled on the printed-wiring board 14 by means of a fixing mechanism 16 structured by bolts and nuts. Incidentally, dashed lines indicate the connection member 24 in the state before those are assembled, in FIG. 1A.

SECOND EMBODIMENT

A second embodiment in the invention is shown in FIGS. 2A and 2B. In this embodiment, the connection mechanism has the same structure as that of the first embodiment. However, differently from the first embodiment, the connection mechanism is attached directly on the semiconductor device socket without the intervention of a pitch-changing board.

In FIGS. 2A and 2B, reference numeral 30 designates a semiconductor device socket (hereinafter referred merely to as a "socket"). The socket 30, in this embodiment, is basically constructed with an operation member 31, a socket body 32 having a receptacle (not shown) to receive therein a semiconductor device, a plurality of contacts 33 provided in the socket body 32 and to be electrically contacted with a semiconductor device received, and a connection mechanism 40 for providing an electric connection with a printed-wiring board 51.

The operation member 31 is attached vertically movable relative to the socket body 32.

In this embodiment, the contacts 33 provided in the socket body 32 are opened and closed by vertical movement of the operation member 31. Specifically, when the operation member 31 is pressed downward, one contact piece 33*a* is moved to the left in the figure while the other contact piece 33*b* retains in the initial position. On this occasion, a semiconductor device can be received in the socket body 32. Meanwhile, the one contact piece 33*a*, moved in relation to the operation member 31 moved upward by a coiled spring 36 provided in the socket 32, is returned to the initial position, thus resulting in clamping the exterior contacts of the semiconductor device. Incidentally, the contacts 33 are not limited to those for clamping the exterior contacts of a semiconductor device but may be in any form provided that it is suited for a semiconductor device to be received.

The contact 33 has a bottom 34 formed flat in shape and to be electrically contacted with the upper free end (first free end) of the connection member 44 of the connection mechanism 40.

The connection mechanism 40, in this embodiment, has the same structure as that of the first embodiment, and hence omitted to detail.

The difference from the first embodiment lies in that the connection member 44 of the connection mechanism 40 contacts at its upper free end (first free end) with the contact bottom 34 and that the connection mechanism 40 is fixed to the socket body 32 by means of a fixing mechanism such as screws 35 provided in through-holes formed in the alignment plate 42.

This embodiment is effective for the case where the semiconductor device received in the socket has external contacts comparatively greater in pitch. This simplifies the structure because of no need to intervene a pitch-changing board.

Meanwhile, positive electric connection is available thus making it easy to change the socket itself or only the connection mechanism.

The present invention has been described in detail with respect to preferred embodiments, and it will now be apparent from the foregoing to those skilled in the art that changes and modifications may be made without departing from the invention in its broader aspect, and it is the invention, therefore, in the appended claims to cover all such changes and modifications as fall within the true spirit of the invention.

What is claimed is:

1. A semiconductor device socket for electrically connecting between a semiconductor device and a printed-wiring board, the semiconductor device socket comprising:

a socket body having contacts to be electrically connected with the semiconductor device; and a connection mechanism provided between the socket body and the printed-wiring board, including connection members for electrically connecting between the contacts and pads of the printed-wiring board and an alignment plate having a cylindrical through-hole, said through-hole having one of the connection members; wherein each connection member provided in the through-hole has a first spring portion having a first free end, a circular support portion having an outer diameter greater than an inner diameter of the through-hole, a positioning portion having an outer diameter smaller than the inner diameter of the through-hole and a second spring poriton and having a second free end, the first and second spring portions are coil springs, the second spring portion has an outer diameter smaller than the inner diameter of the through-hole so as to vertically move within the through-hole, each first free end of each first spring portion electrically connects with one of the corresponding contacts of the socket body and each second free end of each second spring portion electrically connects with the corresponding pad of the printed-wiring board, and the circular support portion abuts against the outer surface of the alignment plate on opposite sides when the positioning portion and the second spring portion of the connection member are inserted in the through-hole, thereby the connection member being retained on the alignment plate.

2. A semiconductor device socket according to claim 1, wherein the outer diameter of the positioning portion is smaller than the outer diameter of the support portion.

3. A semiconductor device socket according to claim 1, wherein the through-hole formed in the alignment plate has an inner surface on which metal plating is applied.

4. A semiconductor device socket for electrically connecting between a semiconductor device and a printed-wiring board, the semiconductor device socket comprising:

a socket body having contacts to be electrically connected with the semiconductor device;

a pitch-changing board having a plurality of contact holes in which the contacts of the socket body are inserted respectively, and a plurality of pads conductively wired from the contact holes at a pitch greater than the pitch of the contacts of the socket body, and a connection mechanism provided between the socket body and the printed-wiring board, including connection members for electrically connecting between the contacts and pads of the printed-wiring board through the pitch-changing board and an alignment plate having a cylindrical through-hole in which one of the connection members is provided; wherein each connection member provided in the through-hole has a first spring portion having a first free end, a circular support portion having an outer diameter greater than an inner diameter of the through-hole, a positioning portion having an outer diameter smaller than said inner diameter of the through-hole and a second spring portion having a second free end, the first and second spring portions are coil springs, the second spring portion has an outer diameter smaller than the inner diameter of the through-hole so as to vertically move within the through-hole, the first free end of each first spring portion electrically connects with the corresponding pad of the pitch-changing board and the second free end of each second spring portion electrically connects with the corresponding pad of the printed-wiring board, the circular support portion abuts against the outer surface of the alignment plate on opposite sides when the positioning portion and the second spring portion of the connection member are inserted in the through-hole, thereby the connection member being retained on the alignment plate, wherein the semiconductor device socket, the pitch-changing board and the alignment plate are assembled on the printed-wiring board by means of a fixing mechanism structured by bolts and nuts.

5. A semiconductor device socket according to claim 1, wherein the first spring portion has an outer diameter smaller than the outer diameter of the support portion.

6. A semiconductor device according to claim 2, wherein the outer diameter of the second spring is smaller than the outer diameter of the positioning portion.

7. A semiconductor device socket for electrically connecting between a semiconductor device and a printed-wiring board, the semiconductor device socket comprising:

a socket body having contacts to be electrically contacted with the semiconductor device; and a connection mechanism provided between the socket body and the printed-wiring board, including connection members for electrically connecting between the contacts and pads of the printed-wiring board and an alignment plate, wherein the alignment plate includes a cylindrical through-hole in which one of the connection members is provided, the connection member provided in the through-hole includes a first spring portion having a first free end, a second spring portion having an outer diameter smaller than an inner diameter of the through-hole and having a second free end a positioning portion having an outer diameter smaller than the inner diameter of the through-hole, and a circular support portion comprising a length of wire shaped to support the first and second spring portions, an outer diameter of the circular support portion is greater than an inner diameter of the through-hole, and the circular support portion abuts against the outer surface of the alignment plate on opposite sides when the positioning portion and the second spring portion of the connection member are inserted in the through-hole, thereby the connection member being retained on the alignment plate.

8. A semiconductor device socket for electrically connecting between a semiconductor device and a printed-wiring board, the semiconductor device socket comprising:

a socket body having contacts to be electrically contacted with the semiconductor device; and a connection mechanism provided between the socket body and the printed-wiring board, including connection members for electrically connecting between the contacts and pads of the printed-wiring board and an alignment plate having a cylindrical through-hole in which one of the connection members is provided;

wherein the connection member provided in the through-hole has a first spring portion having a first free end, a circular support portion having an outer diameter greater than an inner diameter of the through-hole, a positioning portion having an outer diameter smaller than the inner diameter of the through-hole, and a second spring portion having an outer diameter smaller than the inner diameter of the through-hole and having a second free end, and the circular support portion abuts against the outer surface of the alignment plate on opposite sides when the positioning portion and the second spring portion of the connection member are inserted in the through-hole, thereby the connection member being retained on the alignment plate.

9. A semiconductor device socket according to claim 1, wherein the semiconductor device socket and the alignment plate are assembled on the printed-wiring board by means of a fixing mechanism structured by bolts and nuts.

10. A semiconductor device socket according to claim 4, wherein the outer diameter of the second spring portion is smaller than the outer diameter of the positioning portion.

11. A semiconductor device socket according to claim 1, wherein the circular support portion lies in a plane substantially parallel to the alignment plate.

12. A semiconductor device socket according to claim 7, wherein the circular support portion lies in a plane substantially parallel to the alignment plate.

13. A semiconductor device socket according to claim 8, wherein the circular support portion lies in a plane substantially parallel to the alignment plate.

14. A semiconductor device socket according to claim 4, wherein the circular support portion lies in a plane substantially parallel to the alignment plate.

15. A semiconductor device socket according to claim 1, wherein the outer diameter of the second spring portion is smaller than the outer diameter of the positioning portion.

16. A semiconductor device socket according to claim 7, wherein the outer diameter of the second spring portion is smaller than the outer diameter of the positioning portion.

17. A semiconductor device socket according to claim 8, wherein the outer diameter of the second spring portion is smaller than the outer diameter of the positioning portion.

18. A semiconductor device socket according to claim 8, wherein the alignment plate is embedded with a copper foil wire.

19. A semiconductor device socket according to claim 1, further comprising a pitch-changing board having a plurality of contact holes in which contacts of the socket body are inserted, wherein said connection members of said connection mechanism are connected to said pads of said printed-wiring board through the pitch-changing board.

20. A semiconductor device socket according to claim 1, wherein said connection members of said connection mechanism are connected directly to said pads of said printed-wiring board.

21. A semiconductor device socket according to claim 1, wherein the alignment plate is embedded with a copper foil wire.

22. A semiconductor device socket according to claim 7, further comprising a pitch-changing board having a plurality of contact holes in which contacts of the socket body are inserted, wherein said connection members of said connection mechanism are connected to said pads of said printed-wiring board through the pitch-changing board.

23. A semiconductor device socket according to claim 7, wherein said connection members of said connection mechanism are connected directly to said pads of said printed-wiring board.

24. A semiconductor device socket according to claim 7, wherein the alignment plate is embedded with a copper foil wire.

25. A semiconductor device socket according to claim 8, further comprising a pitch-changing board having a plurality of contact holes in which contacts of the socket body are inserted, wherein said connection members of said connection mechanism are connected to said pads of said printed-wiring board through the pitch-changing board.

26. A semiconductor device socket according to claim 8, wherein said connection members of said connection mechanism are connected directly to said pads of said printed-wiring board.

* * * * *

UNITED STATES PATENT AND TRADEMARK OFFICE

CERTIFICATE OF CORRECTION

PATENT NO. : 7,479,016 B2
APPLICATION NO. : 11/492096
DATED : January 20, 2009
INVENTOR(S) : Katunori Takahashi et al.

It is certified that error appears in the above-identified patent and that said Letters Patent is hereby corrected as shown below:

Claim 7, column 9, line 2, “end a” should read --end, a--.

Signed and Sealed this

Twelfth Day of May, 2009

JOHN DOLL
*Acting Director of the United States Patent and Trademark Office*